US009005318B2

(12) United States Patent
Carnegie et al.

(10) Patent No.: US 9,005,318 B2
(45) Date of Patent: Apr. 14, 2015

(54) PROCESS FOR UPGRADING LOW RANK CARBONACEOUS MATERIAL

(75) Inventors: Roderick Howard Carnegie, Woodend (AU); Brendon Gerrard Cooper, South Yarra (AU); William John Stevens, East Melbourne (AU)

(73) Assignee: Pacific Edge Holdings Pty Ltd, Melbourne, Victoria (AU)

( * ) Notice: Subject to any disclaimer, the term of this patent is extended or adjusted under 35 U.S.C. 154(b) by 0 days.

(21) Appl. No.: 14/126,616

(22) PCT Filed: Jun. 18, 2012

(86) PCT No.: PCT/AU2012/000703

§ 371 (c)(1),
(2), (4) Date: Feb. 26, 2014

(87) PCT Pub. No.: WO2012/171080

PCT Pub. Date: Dec. 20, 2012

(65) Prior Publication Data

US 2014/0196362 A1 Jul. 17, 2014

(30) Foreign Application Priority Data

Jun. 17, 2011 (AU) ..... 2011902385

(51) Int. Cl.
*C10L 9/08* (2006.01)
*C10L 5/10* (2006.01)
*C10L 5/36* (2006.01)

(52) U.S. Cl.
CPC ... *C10L 9/08* (2013.01); *C10L 5/10* (2013.01); *C10L 5/361* (2013.01); *C10L 5/363* (2013.01)

(58) Field of Classification Search
CPC ..... C10L 5/447; C10L 5/02; C10L 5/06; C10L 5/24; C10L 5/26; C10L 5/28; C10L 5/34; C10L 5/36; C10L 5/361; C10L 5/363; C10L 5/04; C10L 5/12; C10L 5/00; C10L 5/10; C10L 9/00; C10L 9/02; C10L 9/10; C10L 1/322; C10L 1/326; B30B 9/065; B30B 9/28; B30B 11/227; B30B 11/201; B30B 11/228; B30B 15/0005; C10F 5/00; C10F 7/00; C10F 7/04; C10F 7/08
USPC ..... 44/490, 491, 492, 592, 608, 626
See application file for complete search history.

(56) References Cited

U.S. PATENT DOCUMENTS 4,627,575 A * 12/1986 Johns et al. ..... 241/15
4,701,184 A 10/1987 Harvey et al.

(Continued)

FOREIGN PATENT DOCUMENTS

DE 2 107 775 9/1972
WO WO 01/54819 * 8/2001

(Continued)

OTHER PUBLICATIONS

PCT/AU2012/000703 International Search Report dated Aug. 20, 2012 (5 pages).

(Continued)

*Primary Examiner* — James Goloboy
*Assistant Examiner* — Latosha Hines
(74) *Attorney, Agent, or Firm* — Brinks Gilson & Lione; G. Peter Nichols

(57) ABSTRACT

A process for upgrading brown coal having a first water content including subjecting the brown coal to a conditioning step which includes heating the brown coal to a first temperature to produce a conditioned brown coal having a second water content which is lower than the first water content; attritioning the conditioned brown coal to enable water to be released from the microstructure of the brown coal and thereby producing an admixture of the brown coal and released water; forming aggregates of the admixture; drying the aggregates to produce upgraded brown coal having a third water content which is lower than the second water content.

15 Claims, 1 Drawing Sheet

(56) References Cited

U.S. PATENT DOCUMENTS

| | | | |
|---|---|---|---|
| 6,846,339 | B2 | 1/2005 | Carnegie et al. |
| 7,992,319 | B2 | 8/2011 | Wilson |
| 2003/0037485 | A1 | 2/2003 | Carnegie et al. |
| 2005/0050799 | A1 | 3/2005 | Buchanan et al. |
| 2006/0156622 | A1 | 7/2006 | Katayama |
| 2007/0294911 | A1 | 12/2007 | Wilson |

FOREIGN PATENT DOCUMENTS

| | | |
|---|---|---|
| WO | WO 2004/015034 | 2/2004 |
| WO | WO 2005/028977 | 3/2005 |

OTHER PUBLICATIONS

PCT/AU2012/000703 International Preliminary Report on Patentability dated Aug. 15, 2013 (18 pages).

* cited by examiner

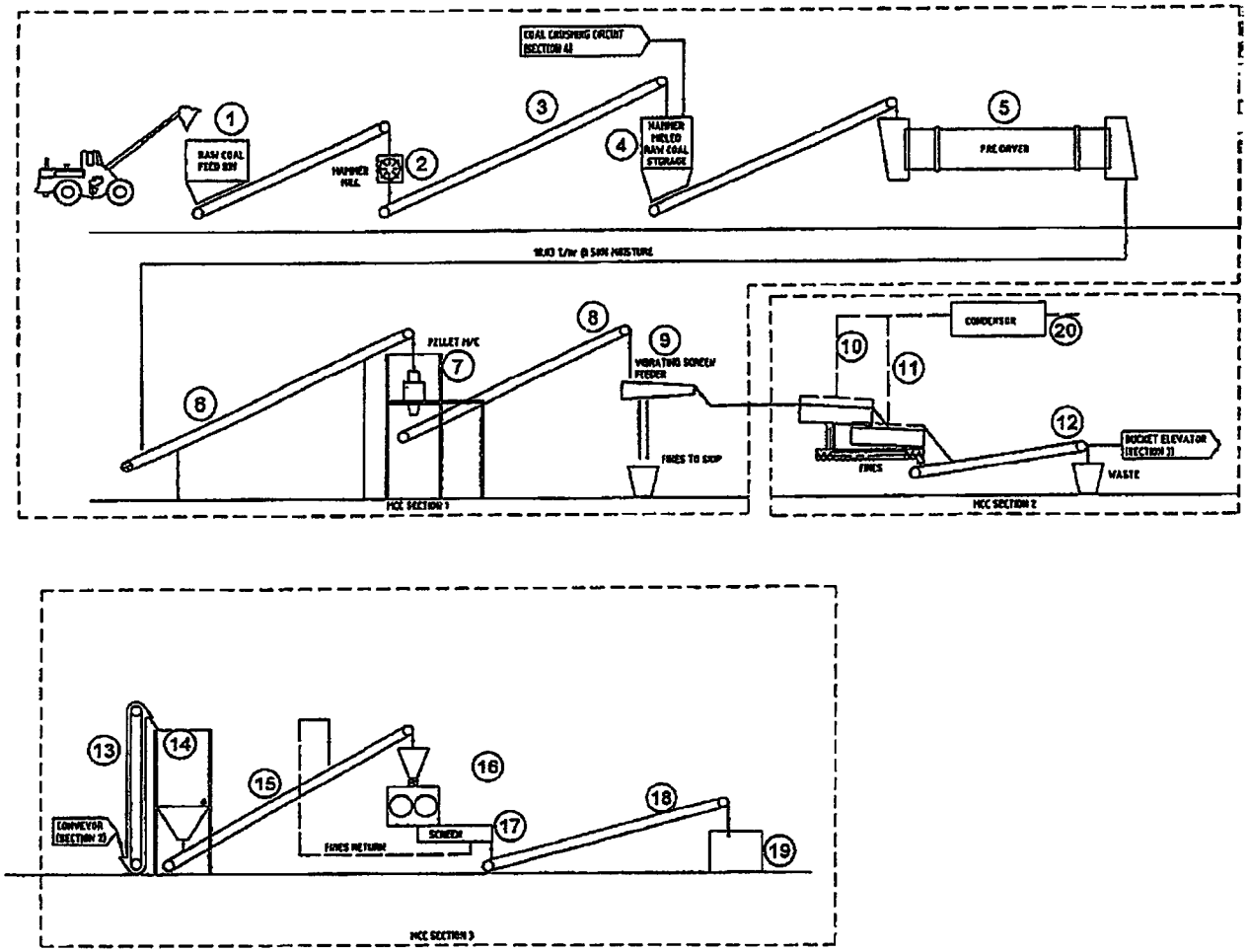
COAL CRUSHING CIRCUIT SECTION #1
RAW COAL FEED BIN
HAMMER MILL
HAMMER MILLED RAW COAL STORAGE
FAE DRYER
1000 T/Hr @ 5.50% MOISTURE
PELLET PVC
VIBRATING SCREW FEEDER
FINES TO SCRP
COMPUTER
BUCKET ELEVATOR (SECTION 3)
WASTE
FINES
MCC SECTION 1
MCC SECTION 2
CONVEYOR (SECTION 2)
SCREEN
FINES RETURN
MCC SECTION 3

PROCESS FOR UPGRADING LOW RANK CARBONACEOUS MATERIAL

This application claims priority to International Application No. PCT/AU2012/000703 filed Jun. 18, 2012, and Australian Patent Application 2011902385 filed Jun. 17, 2011, the entire contents of each are incorporated herein by reference.

TECHNICAL FIELD OF THE DISCLOSURE

This invention relates generally to a process for upgrading low rank carbonaceous material. The invention particularly relates to an improved process of upgrading low rank carbonaceous material which includes a conditioning step. The invention also extends to a process of forming char by heat treating the upgraded product.

BACKGROUND ART

Low rank carbonaceous materials, such as brown coal, peat and lignite, are materials having water locked into a microporous carbonaceous structure. The water content is typically high—for example 60% or higher. This means that such materials have a low calorific value. Moreover, these materials have the undesirable mechanical properties of being soft, friable and of low density, meaning that they are difficult, messy and inconvenient to handle.

Prior process for upgrading low rank carbonaceous materials (which for ease of discussion will be hereinafter collectively referred to as "brown coal") have included "briquetting" and solar drying.

Briquetting typically involves heating the raw brown coal to remove excess water, then pressing the cooled brown coal into briquettes using an extrusion press or roll briquetting machine. However, briquetting is an expensive process due to the requirement for thermal energy and the mechanical wear on the extrusion press or roll briquetting machine.

The solar drying process involves milling of the brown coal with addition of water for long periods (e.g. up to 16 hours), then solar drying of the milled slurry in shallow ponds. This process is lengthy—particularly the solar drying step which may take up to several months—and energy intensive.

Another proposal mechanically releases water from brown coal by physically breaking up the coal. However, this process is inconvenient and time consuming and still requires lengthy air drying of the final product.

Another prior art process is the subject of WO 01/54819 in the name of applicant, the entire disclosure of which is incorporated herein by reference. In that process, brown coal is subjected to shearing-attritioning to form a plastic mass which is then extruded into pellets and air dried.

While a number of upgrading processes have been developed to upgrade brown coal, it has been to date difficult to accommodate the natural variations in the characteristics of brown coal deposits in those processes. Brown coal occurs in a number of deposits around the world, including Australia, USA, Germany, Poland, Indonesia and India. These deposits vary considerably in composition such as in water content and ash content. Even within a specific deposit there are compositional variations. This is particularly relevant for water content which can vary significantly depending on the location within the deposit and even when a particular sample of brown coal is taken (eg, water content of brown coal typically is higher after rain). This variation in composition has implications for the upgrading process conditions selected for the brown coal mined from the deposit. This means that it can be difficult to standardise the process steps used in a particular upgrading process.

It is accordingly an object of the present invention to provide a process for upgrading brown coal which overcomes, or at least alleviates, one or more disadvantages of the prior art.

SUMMARY OF THE DISCLOSURE

In a first aspect there is provided a process for upgrading brown coal having a first water content including:

- subjecting the brown coal to a conditioning step which includes heating the brown coal to a first temperature to produce a conditioned brown coal having a second water content which is lower than the first water content;
- attritioning the conditioned brown coal to enable water to be released from the microstructure of the brown coal; and thereby producing an admixture of the brown coal and released water;
- forming aggregates of the admixture;
- drying the aggregates to produce upgraded brown coal having a third water content which is lower than the second water content.

The conditioning step includes heating the brown coal to a first temperature to produce a conditioned brown coal with reduced water content. The first temperature may be in excess of 40° C. In an embodiment, the first temperature may be in excess of 45° C., such as around 50° C. In another embodiment, the first temperature may be in excess of 50° C., such as around 60° C. In another embodiment, the first temperature may be up to 70° C.

The first water content will depend on the provenance and characteristics of the brown coal deposit. It may vary up to about 75 wt %. In the case of brown coal deposits in Victoria, Australia, the first water content is typically about 60-65 wt %.

The second water content may vary up to about 45-55 wt %, depending on the first water content of the brown coal and the duration of the conditioning step.

The conditioning step may also include comminuting the brown coal, such as by grinding or milling, in order to break up coal lumps and result in a more homogeneous distribution of particle sizes. The brown coal may be comminuted to an average particle size of less than 10 mm, such as less than 8 mm, for example around 5 mm or lower.

The comminuting step may occur before and/or after the heating step. The combination of comminution and heating together improves the efficiency of the conditioning step as compared to either heating or comminution alone. In one embodiment, comminution precedes the heating step. Comminution mechanically releases some of the water from the brown coal microstructure which can be evaporated by the subsequent heating step.

The comminuting step, if included, may also contribute to the heating of the brown coal. The conditioning step may remove excess moisture from the brown coal prior to the attritioning step. The conditioning step also imparts energy into the brown coal and thereby facilitates the subsequent upgrading steps. The conditioning step enables the subsequent attritioning step to be conducted at a lower moisture content (eg at 40 wt % water) than would otherwise be necessary.

The attritioning step may comprise shearing attritioning of the brown coal. The shearing attritioning may be conducted in a nip defined between two or more converging surfaces at least one of which is rollable in a direction toward the nip. The shearing attritioning may be conducted in a mill containing at least one roller, such as in a rotating roll type pelletising mill.

The step of forming an admixture may comprise forming a plastic mass from the attritioned brown coal and released water.

The step of forming aggregates may comprise extruding the admixture through apertures, either substantially immediately after or concurrently with the shearing attritioning, in order to form pellets.

The shearing attritioning and/or aggregate forming steps may be conducted in accordance with WO 01/54819 in the name of applicant, the entire disclosure of which is incorporated herein by reference.

The drying step produces upgraded brown coal having a third water content which is lower than the second water content. The drying step may comprise more than one stage. The third water content may vary from about 10 to 20 wt %. Preferably, the third water content may vary from about 12 to 15 wt %.

The brown coal aggregates may at least partially disintegrate during the drying process as moisture is removed from them. The disintegration of the aggregates occurs at least partially as an inherent result of the drying step and is not due to a separate attritioning step or other mechanical treatment of the aggregates. The disintegration is at least partially due to expansion and release of steam and other hot gases from the interior of the aggregates and at least partially due to unavoidable abrasion of the aggregates during the drying process, especially in the case where a screw dryer is used in one drying stage. Accordingly, by the end of the drying process, and/or of any further drying stages of the brown coal, the brown coal may include or comprise particulate material. The brown coal is then able to be transferred to an agglomerating device, such as a briquetting machine.

The drying step may be conducted in a chamber having a steam containing atmosphere. The applicants have found that when brown coal aggregates are steam dried, the aggregates slowly disintegrate during the drying process as moisture is removed from them. Accordingly, by the end of the drying process the brown coal typically is substantially in particulate form, such as in the form of a powder. The particulate product is then able to be transferred to an agglomerating device, such as a briquetting machine, to produce compacts of the upgraded brown coal. The particulate product may be directly fed to the agglomerating device after drying so as to minimise generation of dust. The particulate product may be directly fed from the drying chamber to the agglomerating device.

The applicants have also found that the use of steam as a drying medium, as opposed to air, can more efficiently dry an upgraded brown coal whilst significantly reducing the generation of dust and the risk of spontaneous combustion during the drying process.

Without wishing to be limited to a particular drying mechanism, it is believed that by using steam instead of air, as the drying medium, the brown coal is able to be heated to a significantly higher temperature by virtue of the higher heat carrying capacity of the steam containing atmosphere. This in turn, enables moisture to be driven off more rapidly and the greater humidity of the steam atmosphere reduces dust generation and the risk of spontaneous combustion.

The drying step may comprise the drying process which is the subject of co-pending provisional patent application No AU2011902384 by the applicant entitled "A process for drying material and dryer for use in the process" the entire disclosure of which is incorporated herein by reference. The drying process disclosed in applicant's co-pending patent application includes the steps of:

providing a moisture containing material (such as low rank carbonaceous material) in a heated chamber having a steam containing atmosphere at a temperature above the dewpoint of the steam, recirculating a hot gas including a portion of the steam through the chamber in order to evaporate moisture from the material to a predetermined level of dryness.

The upgrading process may further include the step of compacting the particulate product, such as by forming briquettes therefrom. In particular, it has been discovered by the applicant that where the particulate product contains around 10 to 20% moisture, such as around 12-15% moisture, the product is able to be briquetted without the need for a binder.

In a second aspect, there is provided upgraded brown coal produced according to the process of the first aspect. The brown coal may be in particulate or compacted form.

In a third aspect, there is provided a process for the production of char utilising as feed material compacted, upgraded brown coal formed in accordance with the process of the first aspect.

BRIEF DESCRIPTION OF DRAWING

Notwithstanding any other forms which may fall within the scope of the apparatus and process as set forth in the Summary, a specific embodiment will now be described, by way of example only, with reference to the accompanying drawing in which:

FIG. 1 is a schematic diagram illustrating the steps of an embodiment of the process.

DETAILED DESCRIPTION OF DRAWING

Referring to FIG. 1, raw, run of mine brown coal having a moisture content of approximately 60% is fed into the feed bin 1 and conveyed to a hammer mill 2. The hammer mill 2 comminutes the brown coal in order to break up large lumps and result in a more homogeneous distribution of particle sizes with an average particle size of around 5 mm. The hammer milled brown coal is conveyed along conveyor 3 to the milled coal storage bin 4.

The milled raw brown coal, still having approximately 60% moisture, is then conveyed to the pre dryer, 5. The hammer milled raw coal is heated in the pre dryer 5 to a temperature of approximately 50° C. The milled raw coal has an average particle size of around 5 mm. After the treatment in the pre dryer 5, the brown coal has a moisture content of around 50%.

The hammer mill and pre dryer stages together comprise a conditioning step whereby the particle size, moisture content and temperature of the brown coal is optimised, which facilitates subsequent processing. The conditioned brown coal is then transferred from the pre dryer 5 to a feed conveyor 6 and is then transferred to an attritioning step 7. The attritioning step comprises subjecting the brown coal to shearing attritioning in a rotating roller type pelletising mill. During the shearing attritioning step, water is released from the microstructure of the brown coal and the admixture of brown coal and released water comprises a plastic mass. The plastic mass is extruded through apertures in the wall of the pelletising mill and formed into aggregates, comprising pellets.

The brown coal pellets are transferred along conveyor 8 to a vibrating screen feeder 9. The vibrating screen feeder 9 feeds the brown coal pellets to a first drying stage 10, comprising a drying chamber substantially in accordance with the disclosure in the applicant's co-pending provisional patent application entitled "A process for drying material and dryer for use in the process". During the drying step in chamber 10, the brown pellets are subjected to a steam containing atmosphere and commence to disintegrate to form particulate coal as they pass through the drying chamber 10. The partially dried pellets have a moisture content of approximately 25% as they exit the drying chamber 10.

The pellets and particulate coal exiting drying chamber 10 enter a second drying chamber 11, comprising a Holo Flite® screw dryer having an auger feed mechanism in which the shaft and flights of each auger are heated such as a by hot oil contained therein. At the end of the second drying chamber 11, the brown coal pellets are substantially completely disintegrated into a particulate product.

Some of the steam in each of the drying chambers 10 and 11 is vented to a condenser 20 where the steam is condensed and captured for possible future use.

The particulate product exiting drying chamber 11 is conveyed along conveyor 12 to a bucket elevator 13 which feeds the particulate coal into a storage silo 14. The particulate coal is fed from the storage silo 14 along the conveyor belt 15 to a briquetter 16 which compacts the particulate, dried brown coal into briquettes. The particulate dried brown coal has approximately 12-15% moisture at which level, a binder is not required in order to form the coal briquettes. The briquettes are fed via vibrating screen feeder 17 along belt conveyor 18 and stored in a bunker 19.

The briquettes formed by the process of the invention have been found to have good mechanical strength and can be transported, such as by ship, without significant breakage or risk of spontaneous combustion.

EXAMPLE

Loy Yang brown coal having 62% by weight water as mined was fed to a hammer mill to decrease the particle size distribution and result in an average particle size of approximately 5 mm. Milling resulted in mechanical release of some water from the coal microstructure. The hammer milled brown coal was then subjected to a predrying stage in a rotary dryer. In the predryer, the brown coal was heated to a temperature of from 45 to 50° C. After the predrying stage, the brown coal had a moisture content of around 50 wt %.

The conditioned brown coal was then passed to an attritioning step. The brown coal was subjected to shearing attritioning and extrusion in a rotating roll type pelletising mill. The shearing attritioning resulted in bond breakage within the coal microstructure and consequent release of moisture. The extruded brown coal was formed into aggregates having around 48% by weight water.

The aggregates were subjected to a three stage drying process. Each stage was conducted at atmospheric pressure and at a temperature in the range from around 120 to 250° C. In Stage 1, the relative humidity (RH) in the chamber was approximately 48%. The aggregates exiting Stage 1 had a moisture content of around 35 wt %. In Stage 2, the drying chamber had a RH of 40% and the aggregates were dried to a moisture content of 22 wt %. In Stage 3, the drying chamber had a RH of 36% and the aggregates were dried to a moisture content of 15 wt %. By the end of Stage 3, the aggregates had partially disintegrated into particulate material.

The resulting mixture of partially disintegrated aggregates and particulate material was fed to a briquetting procedure. The inherent moisture content in the mixture enabled briquetting without the need for a binder. The briquettes were found to have good mechanical strength.

In the claims which follow and in the preceding description of the invention, except where the context requires otherwise due to express language or necessary implication, word "comprise" or variations such as "comprises" or "comprising" is used in an exclusive sense, i.e. to specify the presence of the stated features not to preclude the presence or addition of further features in various embodiments of the invention.

The invention claimed is:

1. A process for upgrading brown coal having a first water content including:

subjecting the brown coal to a conditioning step which includes heating the brown coal to a first temperature in excess of 40° C. and to impart energy into the brown coal to produce a conditioned brown coal having a second water content between 45 and 55 wt % which is lower than the first water content;

attritioning the conditioned brown coal to enable water to be released from the microstructure of the brown coal and thereby producing an admixture of the brown coal and released water;

forming aggregates of the admixture;

drying the aggregates to produce upgraded brown coal having a third water content which is lower than the second water content.

2. A process of claim 1, wherein the first temperature is greater than 45° C.

3. A process of claim 1, wherein the first temperature is in the range of 45 to 55° C.

4. A process of claim 1, wherein the first temperature is in excess of 50° C.

5. A process of claim 1, wherein the second water content is about 50 wt %.

6. A process of claim 1, further including comminuting the brown coal, in order to break up coal lumps and result in a more homogeneous distribution of particle sizes.

7. A process of claim 6, wherein the brown coal is comminuted to an average particle size of less than 10 mm.

8. A process of claim 6, wherein the comminuting step occurs before and/or after the heating step.

9. A process of claim 1, wherein the attritioning step comprises shearing attritioning of the brown coal to form an admixture from the attritioned brown coal and released water.

10. A process of claim 9, further including extruding the admixture through apertures, either substantially immediately after or concurrently with the shearing attritioning, in order to form pellets.

11. A process of claim 1, wherein the third water content varies from about 10 to 20 wt %.

12. A process of claim 1, wherein the drying step is conducted in a chamber under a steam containing atmosphere at a temperature above the dewpoint of the steam, and recirculating a hot gas including a portion of the steam through the chamber in order to evaporate moisture from the material to a predetermined level of dryness.

13. A process of claim 1, wherein the aggregates at least partially disintegrate during the drying step to form particulate coal material.

14. A process of claim 1, further including the step of briquetting the upgraded brown coal.

15. A process for the production of char utilizing as feed material upgraded brown coal formed by the process of claim 1.

* * * * *